US005632400A

United States Patent [19]

Podd, Sr. et al.

[11] Patent Number: 5,632,400

[45] Date of Patent: May 27, 1997

[54] FLOATING HANGING LINER SUPPORT

[76] Inventors: Victor T. Podd, Sr., 255 Beverley Avenue, Montreal, PQ, Canada, H3P 1K8; Victor I. Podd, Jr., 1678 SW. 20th Avenue, Boca Raton, Fla. 33486; Stephen D. Podd, One Lincoln Boulevard, Rouses Point, N.Y. 12979

[21] Appl. No.: 208,270

[22] Filed: Mar. 9, 1994

Related U.S. Application Data

[62] Division of Ser. No. 990,842, Dec. 14, 1992, abandoned, which is a division of Ser. No. 758,766, Sep. 12, 1991, Pat. No. 5,193,710.

[51] Int. Cl.[6] ..... B65D 43/08

[52] U.S. Cl. ..... 220/403; 229/125.27

[58] Field of Search ..... 229/125.26, 125.17, 229/125.27, 114; 220/403, 404

[56] References Cited

U.S. PATENT DOCUMENTS

| | | | |
|---|---|---|---|
| 4,127,230 | 11/1978 | Bamburg et al. | 229/125.27 |
| 4,260,071 | 4/1981 | Bamburg et al. | 229/125.26 |
| 4,272,010 | 6/1981 | Capo | 229/125.27 |
| 4,365,739 | 12/1982 | Webinger | 229/125.26 |
| 4,585,143 | 4/1986 | Fremow et al. | 229/125.26 |
| 5,427,308 | 6/1995 | Swift et al. | 229/125.27 |

*Primary Examiner*—Joseph M. Moy

[57] ABSTRACT

A bulkhead comprises a main section including left and right edges, a left flap connected to and extending outward from the left edge of the main section; and a right flap connected to and extending outward from the right edge of the main section; wherein the main section of the bulkhead laterally extends substantially completely across the back panel of the liner, between the left and right back edges thereof; and the right flap of the bulkhead extends over and is connected to the right flap of the liner to connect the bulkhead thereto, and the left flap of the bulkhead thereto, and the left flap of the bulkhead extends over and is connected to the left flap of the liner to further connect the bulkhead the.

7 Claims, 7 Drawing Sheets

FLOATING HANGING LINER SUPPORT

This application is a divisional application of application Ser. No. 07/990,842 filed on Dec. 14, 1992, now abandoned which is a divisional application of application Ser. No. 07/758,766 filed on Sep. 12, 1991 now U.S. Pat. No. 5,193,710.

BACKGROUND OF THE INVENTION

The present invention generally relates to liners for cargo containers, and more specifically, to liners for containers that are used to carry bulk cargo.

Standardized containers or boxes have come into very extensive use for the shipment of freight by land and sea, and the many advantages of such containers have made it extremely desirable to adapt them for use with as many types of cargo as possible. Accordingly, there have been attempts, with varying degrees of success, to use such standardized containers to carry bulk cargo such as dry bulk chemicals, powdered and pelletized resins, flour, coffee beans, and grain.

When cargo containers are used to carry such bulk cargo, it is important that the container itself either be kept clean or be cleaned after each load of cargo is emptied from the container, so that the container can be subsequently used with another load of cargo. Moreover, it is important to protect the bulk cargo from contamination and from undesirable exposure to the natural elements.

For these reasons, large plastic removable liners are often used to line the interior walls or surfaces of cargo containers that are used to carry bulk cargo. The liners protect the cargo during shipment, for example, from rain and debris; and after the cargo is delivered, the liner can be removed so that the container is again useable, without significant cleaning, to carry other cargo.

Various difficulties have been encountered, however, in using plastic liners in the above-described manner; and in particular, it has been found that the liners may tear or rupture under certain conditions. For example, the general practice in the industry is to try to secure the liners comparatively tightly inside the cargo containers so as to minimize movement of the liners therein. However, bulk cargo loads often shift; and if such a load shifts inside a liner that itself is practically immovable inside a cargo container, then the shifting load may produce high localized stresses on the liner, which in turn may cause the liner to tear or rupture.

In addition, with liners that are used in the above-discussed manner, bulkheads are often secured to the back ends of the liners to help hold and support the liners inside cargo containers, particularly when cargo is being loaded into and discharged from the liners. Commonly, a bulkhead is secured to the back end of a liner by mean of an adhesive, by staples or both; and during transportation, a bulkhead may partially break away from a liner, tearing or rupturing the liner.

SUMMARY OF THE INVENTION

An object of this invention is to firmly secure a liner inside a bulk cargo container while still allowing limited movement of the liner inside the cargo container.

Another object of the present invention is to provide a floating hanging liner support system to support a liner inside a bulk cargo container.

A further object of this invention is to connect a bulkhead to a liner body without requiring that any securing device, such as a staple or nail, penetrate into the interior of the liner body.

Another object of the present invention is to connect a bulkhead securely to an inflatable liner for a cargo container by sandwiching side flaps of that liner between side flaps of the bulkhead.

These and other objectives are achieved with a cargo container and a method of securing a liner inside a cargo container. The cargo container includes a container body defining an interior cargo space, and a flexible and expandable liner secured inside the container body. This liner includes a top panel and left and right side panels; and the top and left side panels are connected together and form a top left edge, and the top and right side panels are connected together and form a top right edge. The cargo container further includes a multitude of liner ties, a multitude of lashing members and first and second ropes or rope segments. The liner ties are connected to and spaced along the liner, adjacent the top left and top right edges thereof, and each of these liner ties forms a channel; and the lashing members are connected to and spaced along the container body, adjacent the top left and top right edges of the liner. The rope or rope segments are connected to the container body and extend through the channels of the liner ties and through the lashing members to support the liner in an upright position in the container body while allowing limited sliding movement of the liner therein.

To secure the liner inside the cargo container, the liner is placed therein, and the first and second rope segments or ropes are secured to the container body, preferably adjacent a front panel of the liner. Then, the first rope or rope segment is threaded through the liner ties and the lashing members on the right side of the liner, and the second rope or rope segment is threaded through the liner ties and the lashing members on the left side of the liner to support the liner inside the cargo container while allowing limited sliding movement of the liner therein. Preferably, the rope or rope segments are then further secured to the cargo container, adjacent a back panel of the liner.

Also disclosed is a combination liner and bulkhead, in which the bulkhead may be secured to the liner without requiring that any securing means such as staples extend into the liner interior. This liner includes a back panel, a back left flap extending outward from a back left edge of the back panel and a back right flap extending outward from a back right edge of the back panel of the liner. The bulkhead includes a main section, a left flap connected to and extending outward from a left edge of the main section, and a right flap connected to and extending outward from a right edge of the main section. The main section of the bulkhead laterally extends substantially completely across the back panel of the liner; and the right flap of the bulkhead extends over and is connected to the right flap of the liner to connect the bulkhead thereto, and the left flap of the bulkhead extends over and is connected to the left flap of the liner to further connect the bulkhead thereto.

Preferably, the left and right flaps of the liner are sandwiched between first and second sections of the left and right flaps, respectively, of the bulkhead. Even more preferably, after the liner flaps are sandwiched between the two sections of the corresponding bulkhead flaps, the sections of each bulkhead flap are stapled together, tightly capturing the corresponding liner flap therebetween.

Further benefits and advantages of the invention will become apparent from a consideration of the following detailed description given with reference to the accompanying drawings, which specify and show preferred embodiments of the invention.

A BRIEF DESCRIPTION OF THE DRAWING

Figure 11:
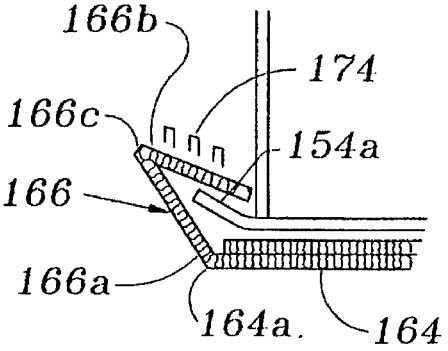
Figure 12:
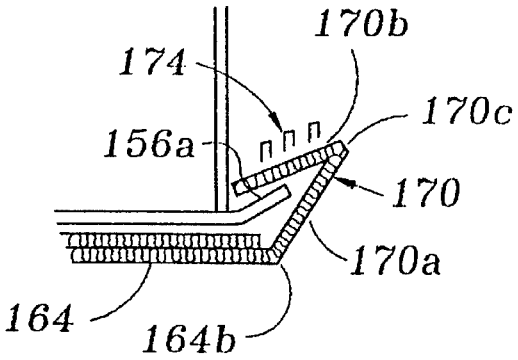
Figure 13:
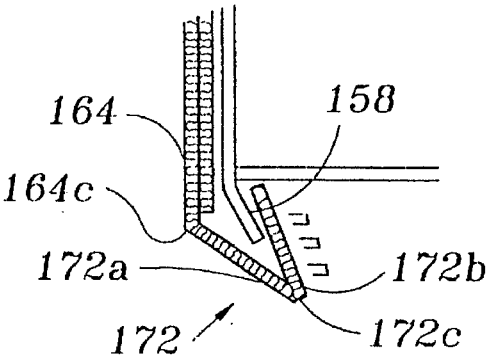

FIGS. 11, 12, and 13 show in detail how various flaps of the liner body may be sandwiched between corresponding flaps of the bulkhead.

Figure 14:
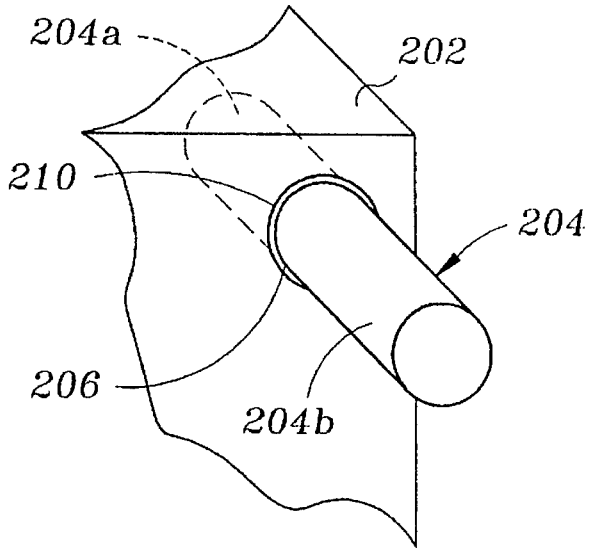
Figure 15:
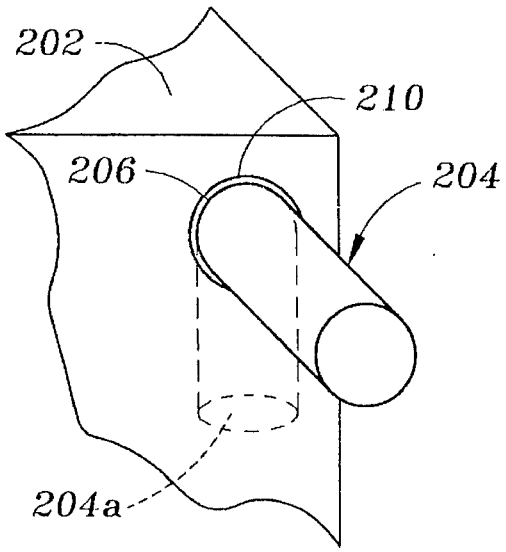
Figure 16:
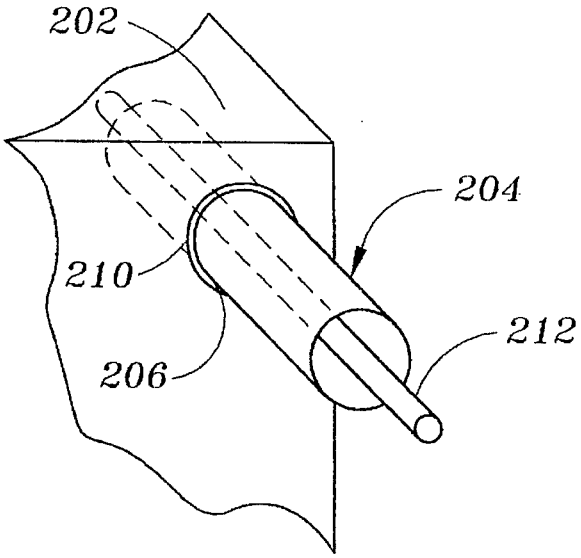

FIGS. 14–16 show a portion of a further, improved container liner having a self-collapsing inlet chute, with the chute being shown in an open position in FIGS. 14 and 16, and in a closed position in FIG. 15.

Figure 17:
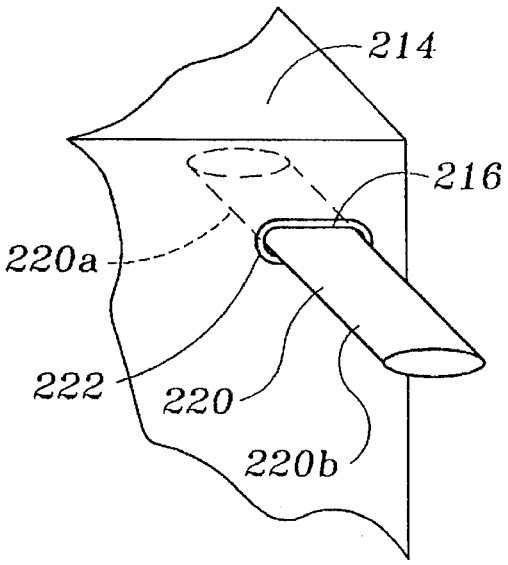
Figure 18:
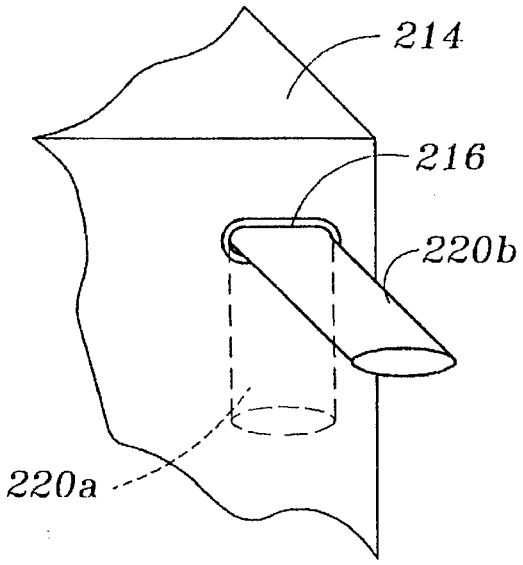
Figure 19:
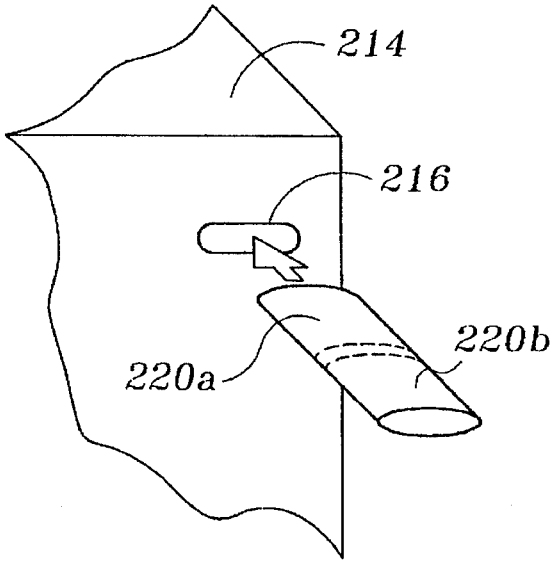

FIGS. 17–19 show a portion of a container liner having an alternate collapsing chute, with this chute being shown in open and closed positions in FIGS. 17 and 18, respectively.

Figure 20:
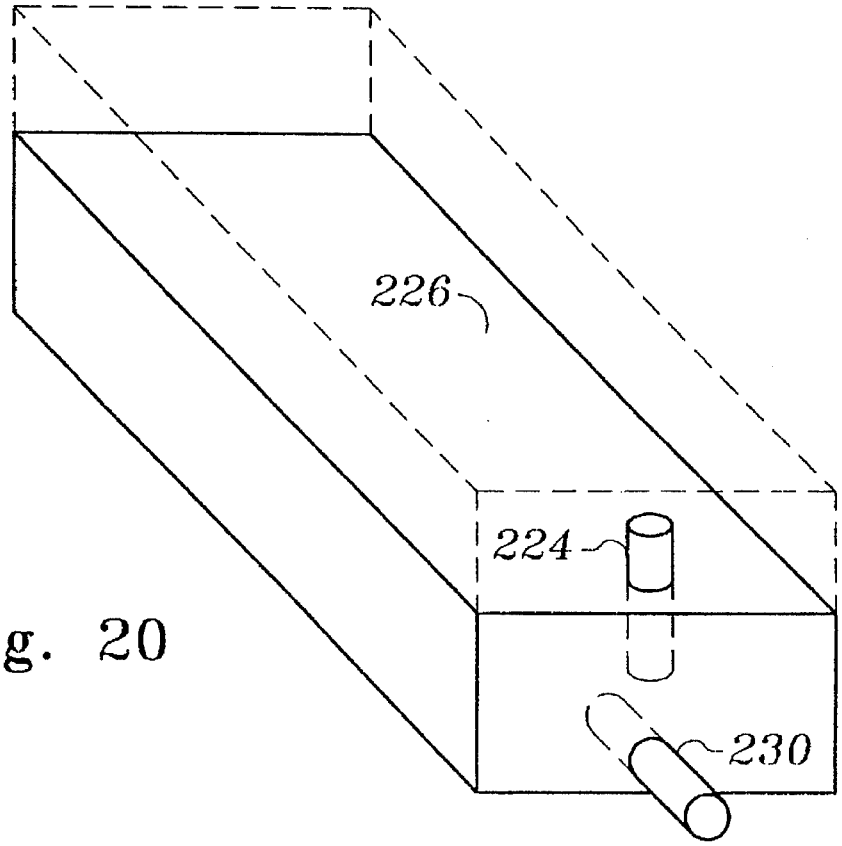
Figure 21:
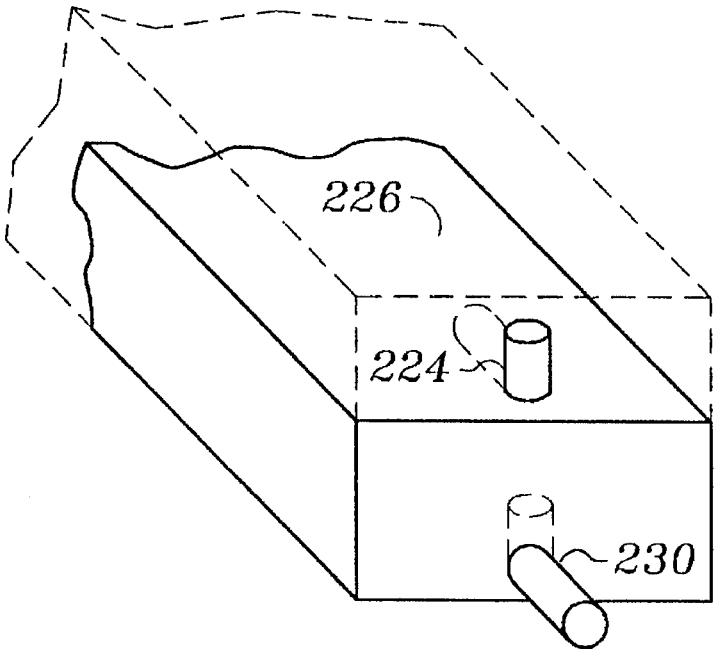

FIGS. 20 and 21 show an expandable and inflatable liner having collapsible chutes at various locations.

DETAILED DESCRIPTION OF THE PREFERRED EMBODIMENTS

Figure 1:
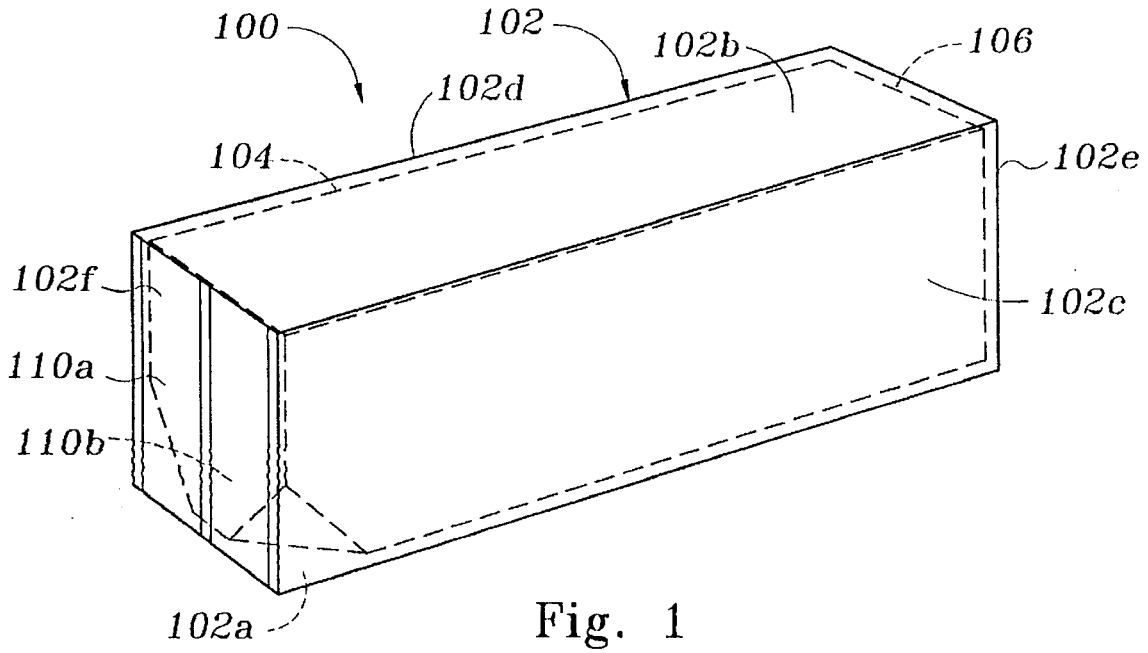
FIG. 1 shows a lined, bulk cargo container embodying the present invention.

FIG. 1 shows cargo container 100, generally, comprising container body 102 and expandable and inflatable liner 104. Container body 102 defines an interior cargo space 106, and includes floor 102*a*, roof 102*b*, left and right side wall 102*c* and d, and front and back walls 102*e* and *f*. Back wall 102*e* includes a pair of outwardly hinged doors 110*a* and *b* that provide access to the interior of the container. Any suitable cargo container may be employed in the practice of this invention, although preferably container body 102 has a conventional size and shape, and even more specifically, the container body is of the type referred to in the art as intermodal and can be transported by truck, railroad, and ship.

Figure 2:
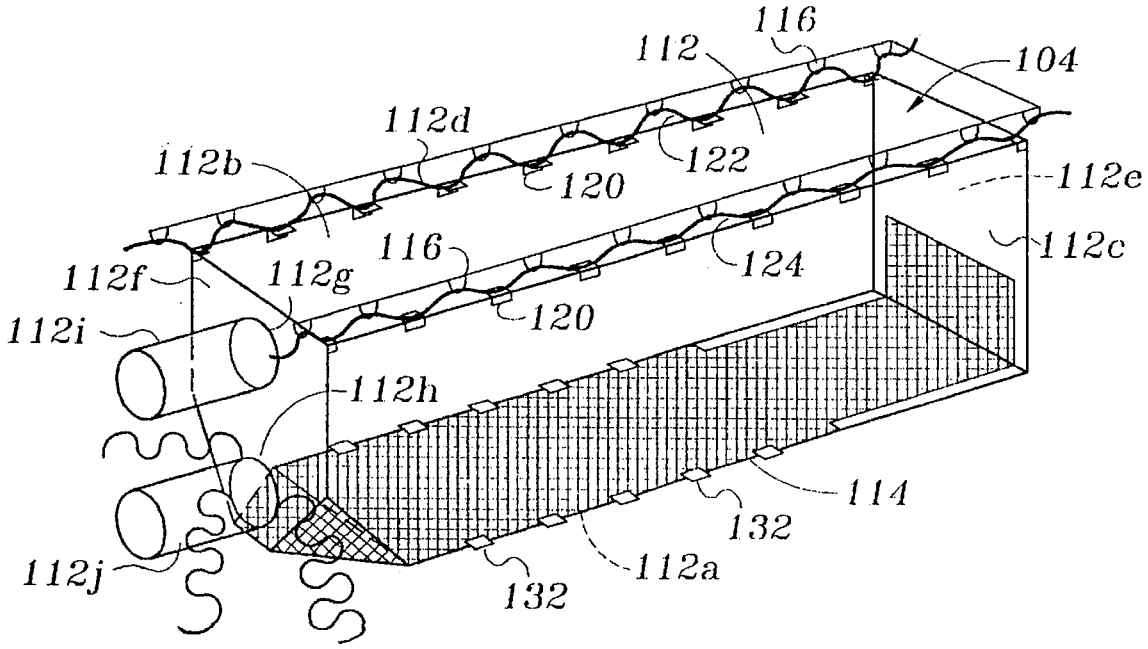
FIG. 2 shows the liner and a portion of the container body of the cargo container of FIG. 1.

With reference to FIGS. 1 and 2, liner 104 comprises a liner body 112, and preferably the liner further comprises reinforcing panel 114. Liner body 112, in turn, includes bottom and top panels 112*a* and *b*, left and right side panels 112*c* and *d*, and front and back panels 112*e* and *f* that are connected or formed together to form the liner body. Liner 104 is employed to line the interior of cargo container body 102; and when the liner is inflated or expanded inside the container body, the shape of the liner partially or substantially conforms to the shape formed by the interior surfaces of that container. It should be noted, though, that the present invention may be practiced with liners that only partially conform to the shape of the interiors of the cargo containers with which the liners are used. For example, many liners are only half the height of the cargo containers with which they are used, and the present invention may also be employed with such liners. As illustrated in FIGS. 1 and 2, liner body 112 has a hollow, substantially parallelepiped shape, although the liner body may have other shapes.

Once liner 104 is positioned inside the cargo container body 102, a bulkhead (not shown) is preferably held or positioned against the back panel of the liner to help support the liner. Any suitable bulkhead may be employed with liner 104, and one such bulkhead is disclosed in detail in U.S. Pat. No. 4,799,607. To accommodate this bulkhead, back panel 112*f* has left and right triangular shaped corner portions that form lower right and left back truncated corners. In addition, inlet and outlet openings 112*g* and 112*h* are provided in back panel 112*f* to conduct cargo into and out of liner 104, respectively. Chutes 112*i* and 112*j*, shown in FIG. 2, may be connected to back panel 112*f*, adjacent openings 112*g* and 112*h*, to facilitate loading cargo into and unloading cargo from the liner 104. These chutes may be tied closed, as desired, to cover or close openings 112*g* and 112*h*.

A heating or cooling element (not shown) such as an electric heating ribbon, wire, rope or pipe element may be placed inside or outside of liner 104 to keep products warm inside the liner during transportation, or to liquify products for discharging. For example, this heating or cooling element may be used to allow semi-liquid products to be loaded into and discharged from a liner, even though those products may normally have a low viscosity and normally do not flow easily, or the products solidify when cooled such as syrup, chocolate liquor, tallow, hot melt adhesive, waxes, lard, and others. It should be noted that this heating or cooling element does not have to be an electric heating element; and, for instance, hot or cooled liquid may be conducted through tubes placed in liner 104 or in cargo container body 102 to heat or cool, respectively, the contents of the liner, if desired.

Liner body 112 may be made in any suitable manner and from any suitable material, and for example, the liner body may be made from a thin plastic material such as polyethylene having a thickness of 7 mils. Liner body 112 may be formed from one large sheet of plastic material and folded into the desired shape. Alternatively, panels 112*a, b, c, d*, and *e* may be formed from one large sheet of material and folded into the desired shape, with back panel 112*f* subsequently connected to the other liner body panels to form the complete liner body. As still another example, each panel of liner body 112 may be formed separately, and the panels may be connected together to form the desired liner body. Any suitable technique may be employed to make any necessary connections between the panel of the liner body; and for instance, the liner body panel may be heat-sealed together, or sewn or glued together.

Reinforcing panel 114 is secured to the bottom panel of liner body 112 to reinforce the latter panel, and preferably the reinforcing panel extends under and is connected to the bottom surface of the bottom panel. Reinforcing panel 114 extends rearward from, or from a position adjacent, the front edge of the liner, and preferably this reinforcing panel extend rearward over the complete length of the bottom panel 112*a*.

Reinforcing panel 114 may also be secured to a bottom portion of front panel 112*e* of liner body 112 to reinforce this area of the latter panel, and preferably the reinforcing panel extends upward approximately 25 percent of the height of panel 112*e*. Reinforcing panel 114 may extend to a higher or lower height; and, if desired, the reinforcing panel may completely cover the front liner panel.

Reinforcing panel 114 also may be made from any suitable material and in any suitable manner, and connected to liner body 112 in any suitable way. Preferably, in liner 104, panel 114 has a high resistance to stretching at least along the length of the liner. For example, the reinforcing panel 114 may be constructed of woven polyethylene and polypropylene fabric also having a thickness of about 7 mils. Alternatively, the reinforcing panel could be made from strips, such as 2 inch strips, of fiberglass tape, metal reinforced tape, or polyester reinforced tape, or the reinforcing panel could be made from coextruded cross-laminated plastic film or co-extruded or cross-laminated film.

The use of reinforcing panel 114 is not necessary to the practice of the present invention in its broadest sense, and it may be possible to provide liner 104 with the desired longitudinal strength by forming the whole liner body 112 from a high-strength material that would provide the desired resistance to stretching. Using the reinforcing panel 114 is preferred, however, because this is a very simple, economical and effective way to provide liner 104 with the desired longitudinal strength.

Cargo container 100 is provided with a support system to support liner 104 inside container body 102; and this support system includes a multitude of lashing members 116, a multitude of liner ties 120, and first and second support ropes or rope segments 122 and 124. Liner ties 120 are connected to and spaced along liner 104 adjacent the top left and top right edges thereof, and lashing members 116 are connected to and spaced along container body, also adjacent the top left and the top right edges of liner 104. First rope or rope segment 122 is connected to container body 102 at or adjacent front panel **112*e* of liner 104, and this rope extends rearward therefrom, through the lashing members and the liner ties on or adjacent the right side of the liner to hold and support that side of the liner. Similarly, rope or rope segment 124 is connected to container body 102 at or adjacent front panel 112*e* of the liner, and this rope extends rearward therefrom, through the lashing members and the liner ties on the left side of the liner body to hold and support that side of the liner. Preferably, rear or back ends of ropes or rope segments 122 and 124 are also connected to container body 102, at or adjacent back panel 112*f* of liner 104**.

Figure 3:
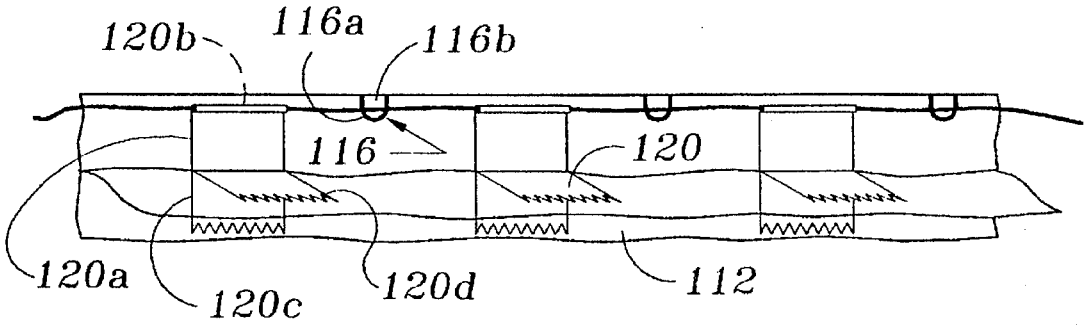
FIG. 3 is an enlarged view of a portion of FIG. 2, showing in detail how a support rope extends through a plurality of lashing and mounting members of the cargo container of FIG. 1.

Liner ties 120 are substantially identical to each other, and FIG. 3 shows several of these ties in greater detail. Generally, each liner tie comprises a strip of material **120*a* connected to liner body 112, adjacent either the top left or the top right edge thereof, and forming an elongated channel 120*b*; and in use, one of the rope segments 122 or 124 extends through that elongated channel. With the preferred embodiment of the mounting members shown in FIG. 3, strip 120*a* is partially folded over itself, and folded over portions of strip 120*a* are connected together to form channel 120*b*. The end portions 120*c* and 120*d* of material 120*a* that are spaced from channel 120*b* are not connected directly together; but instead, in use, one of these end portions is connected to top panel 112*b* of liner 104, and the other end portion is connected to either the left or the right side panel of the liner depending on whether the liner tie is located on the left or the right side, respectively, of the liner. Lashing members 116 also are substantially identical to each other, and FIG. 3 also shows a plurality of these lashing members in greater detail. Each of these lashing members comprises a ring 116*a* that is secured to the container body, adjacent either the left or right top edges of liner 104 depending on whether the lashing member is located on the left or right side of the liner, respectively. Also, each of these rings form a central opening 116*b*, and, in use, one of the rope segments 122 or 124 is extended through that opening to support liner 104 inside cargo container body 102. With the embodiment of the lined cargo container illustrated in FIGS. 1–3, rings 116*a* are connected to the container roof 102*a*, closely adjacent the top left or top right inside edges of the container body. Rings 116*a* may be connected to container body 102 at other locations, however. For instance, if the height of liner 104 is about half the height of the container body 102, rings 116*a*** may be connected to the left and right side walls of the container body at a height slightly more than half the height of the container body.

In addition, preferably each lashing member 116, either alone or in combination with container body 102, forms a closed perimeter extending completely around central opening **116*b*. This closed perimeter is of utility because it prevents any rope that has been inserted through that opening, from slipping off the lashing member. Rings 116*a* may be made of any suitable material and they may be secured in place in any suitable way. For example, these ring may be made of metal and bolted to the container body. With the above-described liner support system, ropes or rope segments 122 and 124 securely hold liner 104 upright in cargo container body 102. At the same time, liner ties 120 are able to slide along those ropes or rope segments for limited distances, and this allows the top portion of liner 104** to move in case a bulk cargo load moves inside the liner. This, in turn, allows that top liner portion to adjust in case localized forces develop inside the liner as a result of shifting loads therein, reducing or minimizing the tendency of those shifting loads to tear or rupture the liner.

Figure 4:
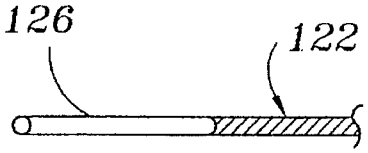
FIG. 4 shows a portion of one end of the support rope of FIG. 3.

Preferably, on each side of the liner 104, the lashing members 116 and the liner ties 120 alternate with each other along the length of the liner. Moreover, in the specific embodiment of cargo container 100 shown in FIGS. 1 and 2, nine liner ties 120 and ten lashing members 116 are provided on each side of liner 104. In addition, with reference to FIG. 4, preferably at least the end of each of the rope segments 122 and 124 that is extended through the lashing members and the liner ties is encased in a heat-shrinkable plastic tubing 126. This tubing adds rigidity to this end of each of the ropes, and allow easier insertion of the rope through the liner ties and the lashing ring.

Figure 5:
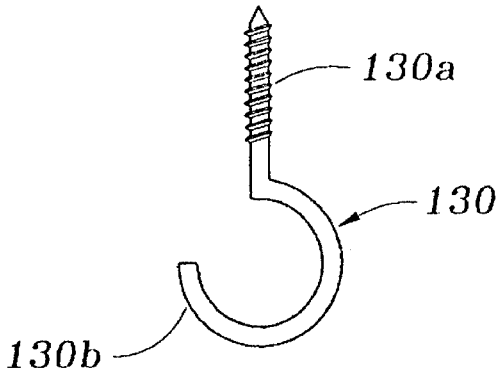
FIG. 5 shows an alternate lashing member that may be used in the present invention.

Other types of lashing members may be used in the present invention. For example, with reference to FIG. 5, each lashing member may comprise a hook 130 having a shank portion **130*a* and an open, curved portion 130*b*. In use, the shank portion is used to connect the hook to container body 102, and the open, curved portion of the hook is used to support one of the support ropes 122 or 124**.

Figure 6:
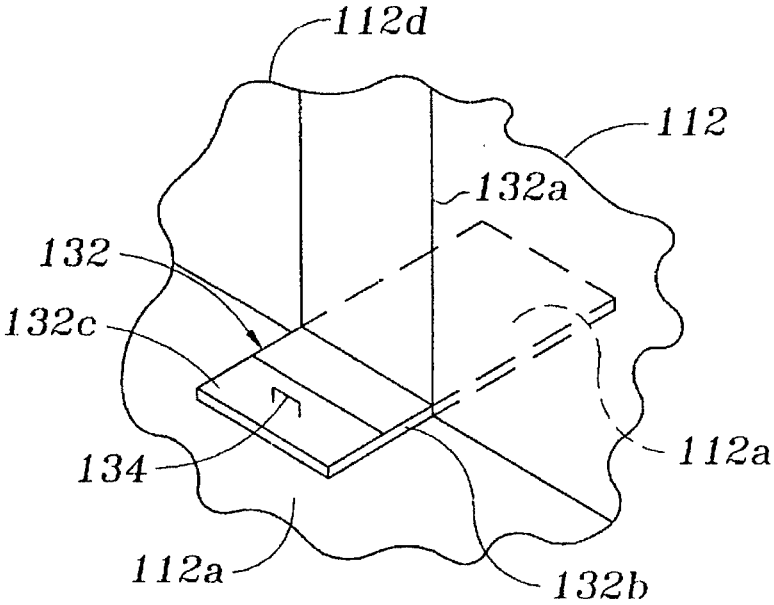
FIG. 6 is an enlarged view of another portion of FIG. 2, showing in detail a bottom fastening member of the liner.

Preferably, liner 104 is also provided with a multitude of lower connecting segments 132 positioned around the liner to help hold the liner inside the container body 102; and in particular, to secure tightly the bottom panel of the liner to the floor of the container body. FIG. 6 illustrates one suitable connecting segment 132 in greater detail. With reference to this Figure, each of the connecting segments 132 comprises a strip of material **132*a*. One end of material 132*a* is connected to the liner body 112, specifically, the bottom panel thereof 112*a*, material 132*a* extends outward from the liner body, over container floor 102*a*, and an outward portion 132*b* of material 132*a* is connected to the container floor. A heat-sealing procedure may be used to connect material 132*a* to the liner body 112, and this material may be connected to container floor by one or more staples 134**.

As will be understood by those of ordinary skill in the art, other means or procedures may be used to connect segment 132 to liner body 112 and to container floor 102*a*; and for example, connecting segment 132 may be nailed or screwed to the container floor. Stapling is preferred, though, because it can be done very easily and inexpensively, and because staples can be removed from the connecting segment quickly and easily. In addition, a reinforcing section 132*c* is preferably added to connecting segment 132, directly onto the portion thereof that is stapled to the container floor.

Other types of connecting segments may be used to connect liner 104 to the floor of container body 102; and for example, a suitable alternative connecting segment is disclosed in copending patent applications Ser. No. 482,030, filed Feb. 15, 1990 and Ser. No. 627,695, filed Dec. 14, 1990. In addition to the foregoing, supplemental connecting or securing means may be used, in addition to lower connecting segments 132, to connect liner 104 to the floor of container body 102. For instance, as taught in the above-mentioned copending application Ser. No. 482,030, wooden slats may be nailed to the container floor, over lower portions or edges of left and right side panels 112*c* and 112*d* of liner 104 to hold the bottom of the liner 104 firmly in place in the container 100.

To install liner 104 inside cargo container body 102, the liner is placed inside the container body, with bottom panel 112*a* on or over the container floor 102*a* and with the left and right bottom edge of the liner adjacent the left and right bottom inside edges of the container body. Liner 104 may be in a collapsed, comparatively flat condition when it is placed in the container body, with top panel 112*b* of the liner lying on or closely over bottom panel 112*a* thereof and with side panels 112*c* and 114*d* folded inward between the top and bottom panels of the liner. The liner 104 may be placed in the container body 102 in a further folded or rolled condition, and then unfolded or unrolled into the above-mentioned comparatively flat condition.

After liner 104 is unfolded or unrolled onto floor 102*a* of container body 102, lower connecting segments 132 are secured to that floor. Supplemental connecting or securing means may be used, in addition to lower connecting segment 132, to connect liner 104 to the floor of the container body. In particular, as previously mentioned, wooden slats may be nailed to the container floor, over lower portions or edges of the left and right side panel of liner 104 to hold the bottom of the liner firmly in place in the container body.

Once the bottom of liner 104 is secured in container body 102, the liner is partially inflated therein, and this may be done by conducting a gas into the interior of the liner via inlet 112*g*. After the liner is partially or fully expanded inside the container body, rope or rope segments 122 and 124 are threaded through and lashing members 116 and liner ties 120 to hold the liner in an upright, expanded position in the cargo container. More specifically, one end of rope segment 122 is tied to the ring 116 at the front of the container, and the second end of this rope segment is threaded through the lashing members 116 and the liner ties 120 on the right side of the liner. Once this second end of rope segment 122 reaches the back of container body 102, the rope segment is pulled taut and tied to a ring 116 at that end of the container body. Similarly, one end of rope segment 124 is tied to the ring at the left front of the cargo container, and the second end of this rope segment is threaded through the lashing members 116 and the liner ties 120 on the left side of the liner, starting from the front of the liner and moving rearward therealong. Once the second end of this rope segment reaches the back of container body 102, the rope is pulled taut and tied to a ring 116 at that end of the cargo container.

After the top portion of liner 104 is hung from container body 102, the liner may be fully inflated and a bulkhead may be installed in the cargo container, against back panel 112*f* of the liner. Further bracing may be provided to support the back panel of the liner. A number of excellent systems for bracing the bulkhead and the back panel of the liner are disclosed in the above-mentioned patent application Ser. No. 627,695, filed Dec. 14, 1990. Once liner 104 is fully secured and braced inside container body 102, cargo may be loaded into the lined container, also via inlet 112*g*. When this is completed, the cargo container 100 is transported to a destination, and there the cargo container is unloaded. Typically, this is done by opening outlet 112*h* and raising the front end of the container so that the cargo therein slides rearward and out through the outlet opening in liner back panel 112*f*.

As previously mentioned, a liner for a cargo container may be made by folding various sections of a tubular member to form top, bottom, front, back, and left and right panels of the liner. FIGS. 7–13 show a procedure for shaping or folding a tubular member 150 into a liner for a cargo container, and then attaching a bulkhead to that liner. In this procedure, various folds or flaps are formed on the liner as it is made; and these flaps are then used to attach the bulkhead to the liner without requiring that any securing device, such as staples or nails, extend into or be inserted into the interior of the liner.

Figure 7:
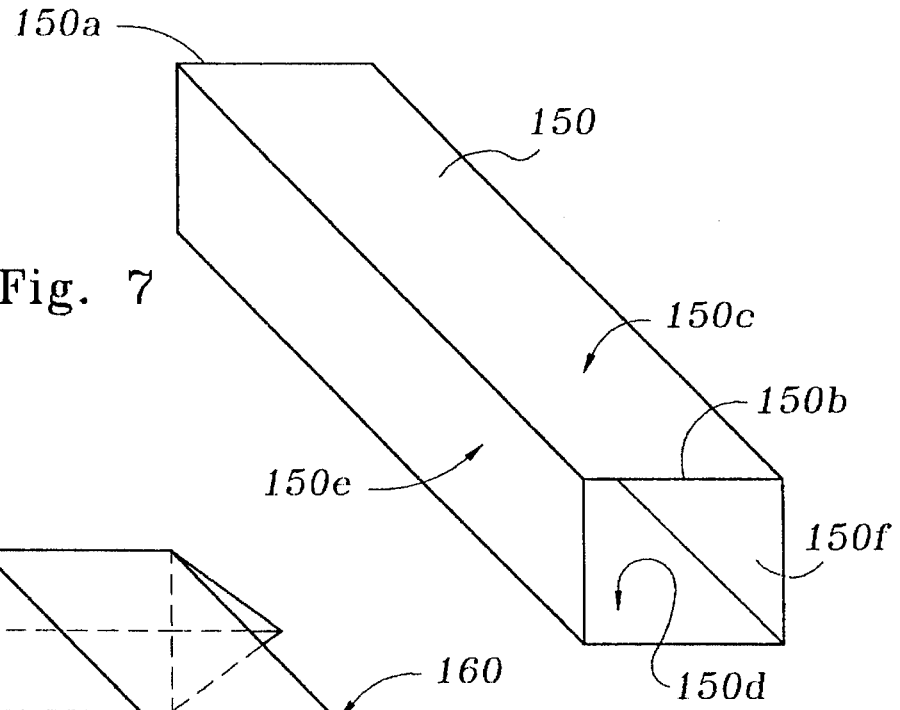
FIG. 7 shows a flexible tubular body from which a liner for a cargo container may be made.
Figure 8:
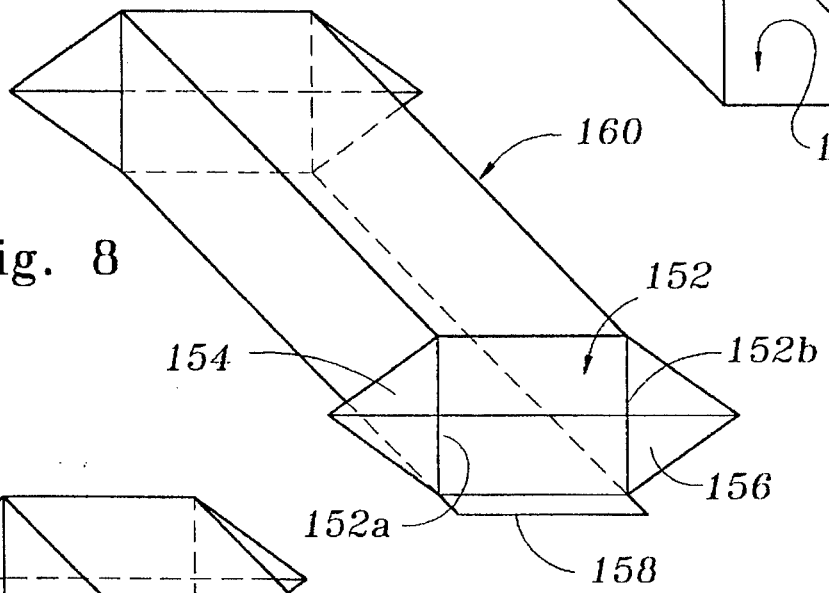
FIG. 8 illustrates how sections of the tubular body of FIG. 7 may be folded together to form a back panel of a liner for a cargo container.

FIG. 7 shows a flexible tubular member 150 having front and back ends 150*a* and *b*. To form a liner from this tubular member, first and second sections 150*c* and *d* of the tubular member, both of which extend forward from the back end of that member, are folded toward each other to form, as shown in FIG. 8, back panel 152 and left and right side flaps 154 and 156. More specifically, section 150*c* is folded downward about an edge, which becomes the top back edge of the liner; and section 150*d* is folded upward about an edge, which become the bottom back edge of the liner. As sections 150*c* and *d* are so folded, a portion of section 150*c* and a portion of section 150*d* are folded against a third section 150*e* of tubular member 150, forming left flap 154, which has a generally triangular shape; and, at the same time, a portion of section 150*c* and a portion of section 150*d* are folded against a fourth section 150*f* of the tubular member, forming right flap 156, which also has a generally triangular shape. In addition, preferably, as the various sections of tubular member 150 are folded to form back panel 152 and flaps 154 and 156, a bottom flap 158 is also formed extending outward from a bottom edge of that back panel.

After sections 150*c* and 150*d* are folded, as described above, various edges of back panel 152 are sealed together. Specifically, left and right edges 152*a* and *b* of the back panel are connected to adjacent portions of tubular member 150; and in particular, those edges are respectively connected to portions of the tubular member 150 that are, or that become, the left back and the right back edges of the liner 160 formed from the tubular member. In addition, the bottom edge of section 150*c* and the top edge of section 150*d* are connected together, extending laterally across the middle of back panel 152. Edges 152*a* and *b* may be connected to the adjacent portion of tubular member 150, and the edges of sections 150*c* and 150*d* may be connected to each other in any suitable manner, such as by heat sealing. Preferably, section 150*c* is connected to section 150*d* along at least the full width of back panel 152, and edges 152*a* and 152*b* are connected to the adjacent portion of tubular member 152 along the entire height of those edges, forming an H-shaped seal on the back panel.

Figure 9:
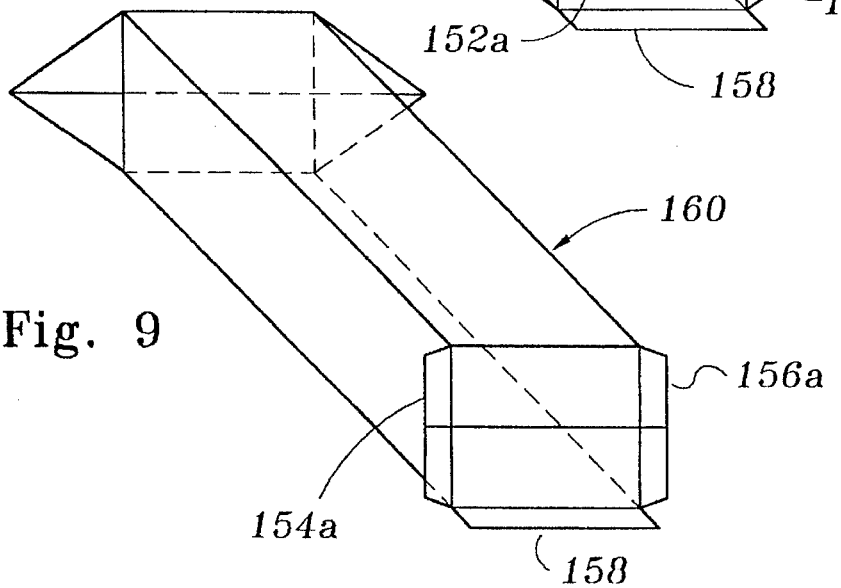
FIG. 9 shows the liner body of FIG. 8 after portions of the back side flap have been trimmed away.

In FIG. 7, tubular member 150 is shown in an inflated or expanded condition, with a generally uniform, rectangular, transverse cross-section and having well-defined bottom, top, and left and right sides. It is not necessary that the tubular members have that shape when sections 150*c* and 150*d* are folded together, however; and those sections may be folded together to form back panel 152 when tubular member 150 itself is in a relatively flat condition or in a partially expanded or inflated condition. After the left and right edges of panel 152 are connected to the adjacent portions of tubular member 150, most, but not all, of the left and right side flaps 154 and 156 are cut off, leaving left and right connecting flaps 154*a* and 156*a*, as shown in FIG. 9. These flaps are used to connect a bulkhead to liner 160, as described below.

Figure 10:
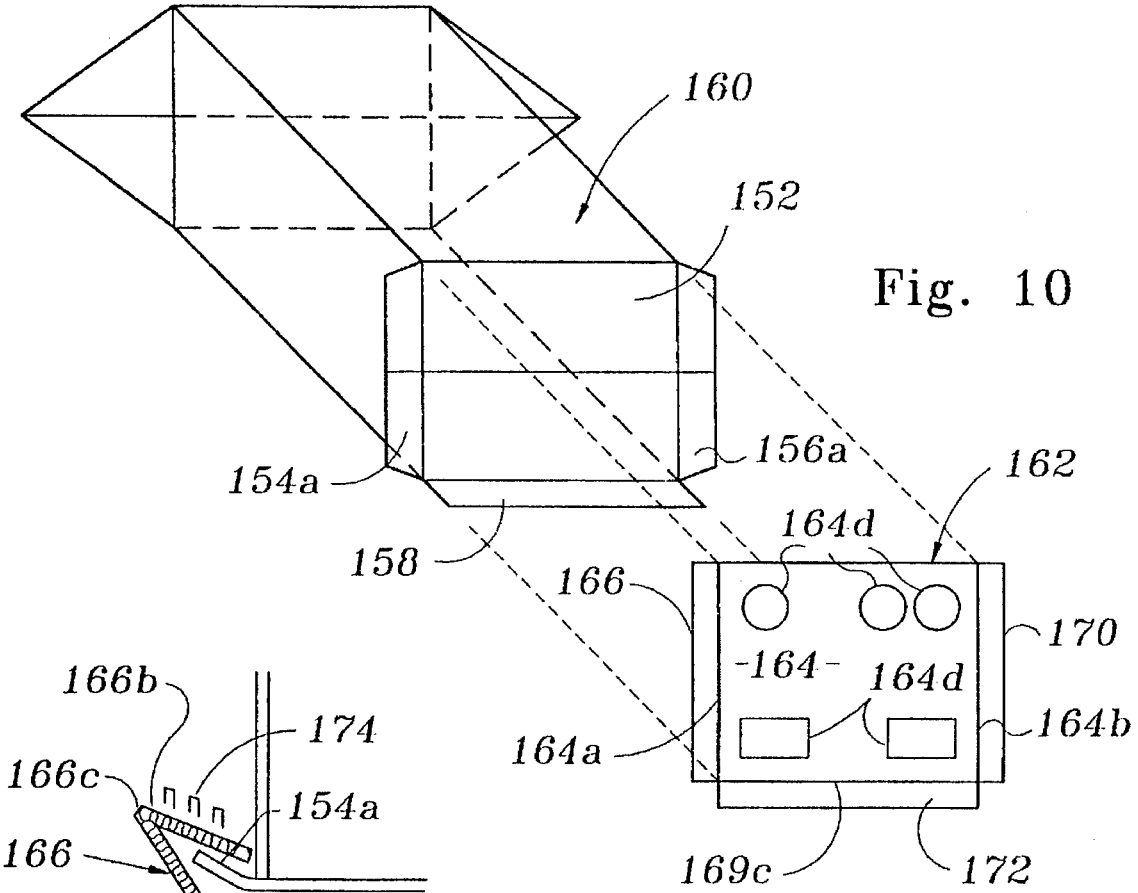
FIG. 10 shows the liner body of FIG. 9 and a bulkhead adapted to be fastened thereto.

With reference to FIG. 10, bulkhead 162 has a comparatively flat shape, comprising a main, or central, body section 164, and left, right, and bottom connecting flaps 166, 170, and 172. Left flap 166 is foldably connected to body section 164, along a left edge 164*a* thereof; right flap 170 is foldably connected to body section 164, along right edge 164*b* thereof; and bottom flap 172 is foldably connected to body section 164, along bottom edge 164*c* thereof.

Each of the connecting flaps of bulkhead 162, in turn, include a pair of sections, a first of which is foldably connected to the body section of the bulkhead, and a second of which is foldably connected to the first section of the flap. More specifically, with particular reference to FIG. 11, flap 166 includes sections 166*a* and *b*. Section 166*a* is foldably connected to body section 164 along edge 164*a*, and section 166*b* is foldably connected to flap section 166*a* along a fold line 166*c*, which extends parallel to edge 164*a*. Preferably the height of each flap section 166*a* and *b* is the same as the height of body section 164, and these two flap sections have equal widths. Similarly, with reference to FIG. 12, flap 170 includes flap section 170*a* and 170*b*. Section 170*a* is foldably connected to body section 164 along edge 164*b*, and section 170b is foldably connected to flap section 170*a* along a fold line 170*c*, which extends parallel to edge 164*b*. Preferably, the height of each flap section 170*a* and *b* is the same as the height of body section 164, and these two flaps sections have equal widths. In addition, with reference to FIG. 13, bottom flap 172 includes flap sections 172*a* and 172*b*; and section 172*a* is foldably connected to the body section 164 along edge 164*c*, and section 172*b* is foldably connected to flap section 172*a* along a fold line 172*c*, which extends parallel to edge 164*c*. Preferably the length of each of the flap sections 172*a* and 172*b* is the same as the width of body section 164, and these two flap sections have equal widths.

The size and shape of main body section 164 of bulkhead 162 is substantially commensurate with the size and shape of back panel 152 of liner 160. Also, the width of each section of each bulkhead flap is slightly more than the width of the corresponding flap of liner 160. In particular, the width of each bulkhead flap section 166*a* and 166*b* is slightly greater than the width of liner flap 154*a*, the width of each bulkhead flap section 170*a* and 170*b* is slightly greater than the width of liner flap 156*a*, and the width of each bulkhead flap section 172*a* and 172*b* is slightly greater than the width of liner flap 158.

To attach bulkhead 162 to liner 160, the bulkhead is positioned against back panel 152 of the liner. More specifically, the central body section 164 of the bulkhead is positioned against back panel 152, substantially co-terminus therewith. Also, left bulkhead flap 166 is positioned against left liner flap 154*a*, right bulkhead flap 170 is positioned against right liner flap 156*a*, and bottom bulkhead flap 172 is positioned against bottom liner flap 158. Then, each bulkhead flap is connected to the corresponding liner flap; and preferably this is done by sandwiching each liner flap between the two sections of the corresponding bulkhead flap, and then stapling together the two sections of each bulkhead flap with the corresponding liner flap tightly captured between these two bulkhead flap sections.

More specifically, with reference to FIG. 11, left bulkhead flap section 166*a* is positioned directly against liner flap 154*a*, bulkhead flap section 166*b* is folded around liner flap 154*a*, sandwiching the liner flap between the two bulkhead flap sections 166*a* and *b*, and then these two bulkhead flap sections are stapled together, by means of staples 174, to capture liner flap 154*a* therebetween. Likewise, as may be best understood from FIG. 12, right bulkhead flap section 170*a* is positioned directly against liner flap 156*a*, bulkhead flap section 170*b* is folded around this liner flap, sandwiching that liner flap between the two bulkhead flap sections 170*a* and *b*, and staples 174 are then used to staple together these two bulkhead flap sections to capture liner flap 156*a* between them. Also, with particular reference to FIG. 12, bottom bulkhead flap section 172*a* is positioned directly against liner flap 158, bulkhead flap section 172*b* is folded over this liner flap, sandwiching that liner flap between the two bulkhead flap sections 172*a* and *b*, and then these bulkhead flap sections are stapled together to capture liner flap 158 therebetween.

In addition to the foregoing, a pressure sensitive adhesive is preferably applied onto the entire backside of bulkhead 162—that is, the side of the bulkhead that is positioned directly against liner panel 152 and flaps 154*a*, 156*a*, and 158—to help secure the bulkhead to the liner.

Any suitable procedure may be used to form a front panel for liner 160. For instance, with reference to FIGS. 7 and 8, sections of tubular member 150 adjacent the front end thereof may be folded and then connected together to form a front panel of the liner. Alternatively, a separate piece of material may be connected to front end 150*a* of tubular member 150 to form a front panel.

Liner 160 may be made from any suitable material, such as a thin polyethylene material; and the liner may be stored, handled, and secured in a cargo container in any suitable manner. For example, the liner may be provided with a multitude of the connecting segments 132 described above to help hold the liner in place in a cargo container.

Bulkhead 162 may also be made of any suitable material; and for example, the bulkhead may be made from a single blank of corrugated cardboard, which is scored to form fold lines 164*a*, *b*, and *c*, 166*c*, 170*c*, and 172*c*. Alternatively, the central section 164 and flaps 166, 170, and 172 may each be formed from a respective one, separate piece of material, which are connected together to make the bulkhead. In addition, it should be noted that, in assembly, the two sections of each of the bulkhead flaps 166, 170, and 172 may be connected together by means other than staples, and for example, nails or screw may be used. Stapling is preferred, however, because it is a relatively simple and inexpensive, yet very effective procedure. Also, bulkhead 162, specifically central section 164 thereof, may be provided with openings or with score lines, generally references at 164*d*, to form cargo inlet and outlet openings in the bulkhead.

As discussed above, with liners of the type that are used to line the interiors of modular cargo containers, inlet and outlet chutes are commonly connected to the liners to help conduct cargo into and to help discharge the cargo from the interiors of the liners. Typically, these chutes are tied closed to prevent cargo from being discharged through the chutes from the interior of the liner while the cargo container is being transported. FIGS. 14 and 15 illustrate a further, improved flexible and inflatable liner having a self-collapsing inlet chute that eliminates the need to tie the chute closed.

More specifically, FIGS. 14 and 15 illustrate a portion of liner 202 and inlet chute 204. Liner 202 defines an interior for holding a bulk cargo, and forms a cargo inlet opening 206. The specific embodiment of liner illustrated in part in FIGS. 14 and 15 has a substantially parallelepiped shape and includes top and back panels, each of which has a generally flat, rectangular shape. As will be appreciated, however, liners having other shapes may be employed in the practice of the present invention.

Inlet chute 204 extends through inlet 206, and includes interior and exterior portions 204*a* and 204*b*, which are respectively located inside and outside liner 202. Preferably, chute 204 is sealed to the liner 202, around inlet 206, as referenced at 210, to prevent cargo from passing into or out of the liner interior through the interface between chute 204 and liner 202. A heat sealing procedure may be used to seal the chute to the liner, although other suitable connecting procedures may also be used.

To load cargo into liner 202, chute 204 is opened into a position, shown in FIG. 14, in which the chute forms a tubular shaped passageway, and the cargo is simply conducted through the chute and into the liner interior. Typically, bulk cargo is loaded into a liner by forcing the cargo thereinto under pressure; and as this is done, the air pressure inside the liner increases to a level greater than the air pressure outside the liner. When the loading of the cargo into the liner 202 is completed, the air pressure therein forces the inner portion 204*a* of the chute 204 into a comparatively flat, closed position against the liner, specifically the back panel thereof, as shown in FIG. 15. This closes inlet 206 and prevents cargo from passing out through the chute 204.

To help keep chute 204 in its open position while cargo is being loaded through that chute, a stiff or rigid tubular member, such as a pipe or a similar device 212, may be positioned inside the chute, as shown in FIG. 16. This tubular member is removed from the chute after the desired amount of cargo is loaded into the liner to allow the chute to collapse into its closed position.

FIGS. 17–19 show a portion of an alternate liner 214, in which the liner 216 inlet is formed by an elongated slit. More specifically, liner 214 also defines an interior for holding a bulk cargo, and forms an inlet opening 216, which comprises an elongate slot cut into the liner. Inlet chute 220 extends through inlet 216 and includes interior and exterior portions 220*a* and 220*b*, which are respectively located inside and outside liner 214. Chute 220 is sealed to the liner 214 around inlet 216, as referenced at 222, to prevent cargo from passing into or out of the interior of the liner, through the interface between chute 229 and liner 214. Preferably, as with the embodiment of the invention shown in FIGS. 14–16, this sealing is achieved by a heat sealing procedure. If such a heat sealing procedure is used with the embodiment of the invention shown in FIGS. 17 and 18, it may be desirable to temporarily insert an insulating material or member into the chute 220 and in inlet 216, between the top and bottom sides of chute 220, to prevent those sides of the chute being sealed to each other.

Cargo may be loaded into the liner 214 in an manner analogous to the procedure discussed above in connection with FIGS. 14–16. Also, chute 220 is moved between open and closed positions, shown in FIGS. 17 and 18, respectively, in the same way in which chute 204 of FIGS. 14–16 is moved between its open and closed positions.

For the sake of simplicity, FIGS. 14–19 illustrate only portions of liners 202 and 214. As will be understood by those of ordinary skill in the art, each of these liners may be formed from any suitable material and in any suitable procedure, and these liners may be provided with numerous items such as connecting segments 132 and liner ties 120 described above. Also, normally each liner is provided with an outlet opening to discharge cargo from the liner, and a chute, which may or may not be self- collapsing, may be connecting to the liner to facilitate conducting cargo from the discharge outlet.

Self-collapsing chutes may be connected to the liners at a multitude of locations, and these chutes may be used both as inlet and outlet chutes. For instance, as shown in FIGS. 20 and 21, a self-collapsing chute 224 may be connected to a top panel of an expandable liner 226 and, also, a self-collapsing chute 230 may be connected to a back panel of liner 226 and used to discharge cargo therefrom. It may be particularly useful to connect self-collapsing chutes to the top panels of liners when the liner is used to transport liquid or semi-liquid cargos.

The liners disclosed herein may be used to carry a large variety of products including dry bulk chemicals, powdered and pelletized resins, flour, coffee, grains, and liquid and semi-liquid materials.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A combination liner and bulkhead, comprising:

a flexible and expandable liner including back, and left and right side panels, wherein the back and left side panels form a left back edge and the back and right side panels form a right back edge, the liner including a left back flap connected to and extending outward from said left back edge, and a right back flap connected to and extending outward from said right back edge;

a bulkhead including i) a main section including left and right edges, ii) a left flap connected to and extending outward from the left edge of the main section, and iii) a right flap connected to and extending outward from the right edge of the main section;

wherein the main section of the bulkhead laterally extends substantially completely across the back panel of the liner, between the left and right back edges thereof; and the right flap of the bulkhead extends over and is connected to the right flap of the liner to connect the bulkhead thereto, and the left flap of the bulkhead extends over and is connected to the left flap of the liner to further connect the bulkhead thereto.

2. A combination liner and bulkhead according to claim 1 wherein:

the left flap of the bulkhead includes i) a first section connected to the left edge of the main section of the bulkhead, and ii) a second section foldably connected to the first section of the left flap of the bulkhead;

the second section of the left flap of the bulkhead is folded over the first section thereof, with the left flap of the liner sandwiched between the first and second sections of the left flap of the bulkhead;

the right flap of the bulkhead includes i) a first section connected to the right edge of the main section of the bulkhead, and ii) a second section foldably connected to the first section of the right flap of the bulkhead; and the second section of the right flap of the bulkhead is folded over the first section thereof, with the right flap of the liner sandwiched between the first and second sections of the right flap of the bulkhead.

3. A combination liner and bulkhead according to claim 2, wherein:

the first and second sections of the left flap of the bulkhead are stapled together, with the left flap of the liner captured therebetween; and the first and second sections of the right flap of the bulkhead are stapled together, with the right flap of the liner captured therebetween.

4. A method of securing a bulkhead to a liner, the liner including back and left and right side panels, and left and right back flaps, wherein the back and left side panels form a back left edge and the left back flap extends outward therefrom, and the back and right side panels form a back right edge and the right back flap extends outward therefrom; the bulkhead including a main section including left and right edges, a left flap connected to and extending outward from the left edge of the main section, and a right flap connected to and extending outward from the right edge of the main section, the method comprising:

positioning the main section of the bulkhead against the back panel of the liner with said main section laterally extending substantially completely across said back panel;

connecting the left flap of the bulkhead to the left flap of the liner to connect the bulkhead thereto; and connecting the right flap of the bulkhead to the right flap of the liner to further connect the bulkhead thereto.

5. A method according to claim 4, wherein:

the step of connecting the left flap of the bulkhead to the left flap of the liner includes the step of sandwiching the left flap of the liner between first and second sections of the left flap of the bulkhead; and the step of connecting the right flap of the bulkhead to the right flap of the liner includes the step of sandwiching the right flap of the liner between first and second sections of the right flap of the bulkhead.

6. A method according to claim 5, wherein:

the step of connecting the left flap of the bulkhead to the left flap of the liner further includes the step of stapling together the first and second sections of the left flap of the bulkhead with the left flap of the liner captured therebetween; and the step of connecting the right flap of the bulkhead to the right flap of the liner further includes the step of stapling together the first and second sections of the right flap of the bulkhead with the right flap of the liner captured therebetween.

7. A method according to claim 4, wherein the positioning step includes the steps of:

applying an adhesive to a back surface of the main section of the bulkhead; and placing said back surface directly onto the back panel of the liner to adhere the bulkhead thereto.

* * * * *